US005774149A

United States Patent [19]

Shimizu

[11] Patent Number: 5,774,149

[45] Date of Patent: Jun. 30, 1998

[54] INK JET RECORDING HEAD AND APPARATUS

[75] Inventor: Eiichiro Shimizu, Urawa, Japan

[73] Assignee: Canon Kabushiki Kaisha, Tokyo, Japan

[21] Appl. No.: 517,682

[22] Filed: Aug. 22, 1995

[30] Foreign Application Priority Data

Aug. 24, 1994 [JP] Japan ..... 6-199853

[51] Int. Cl.[6] ..... B41J 2/05

[52] U.S. Cl. ..... 347/63; 347/20

[58] Field of Search ..... 347/65, 63, 20

[56] References Cited

U.S. PATENT DOCUMENTS

| | | | |
|---|---|---|---|
| 4,803,499 | 2/1989 | Hayamizu | 347/63 |
| 5,095,321 | 3/1992 | Saito et al. | 347/63 |
| 5,097,274 | 3/1992 | Drake | 347/42 |
| 5,121,143 | 6/1992 | Hayamizu | 347/63 |
| 5,160,403 | 11/1992 | Fisher | 347/42 X |
| 5,436,649 | 7/1995 | Nakagomi | 347/20 |

FOREIGN PATENT DOCUMENTS

| | | | |
|---|---|---|---|
| 29878/92 | 2/1993 | Australia | B41J 2/14 |
| 35156/93 | 5/1993 | Australia | B41J 2/145 |
| 40351/95 | 2/1996 | Australia | B41J 2/14 |
| 0419180 | 3/1991 | European Pat. Off. | B41J 2/05 |
| 0538842 | 4/1993 | European Pat. Off. | B41J 2/16 |
| 4039525 | 6/1992 | Germany | B41J 2/16 |
| 3-101958 | 4/1991 | Japan | B41J 2/045 |
| 3-121854 | 5/1991 | Japan | B41J 2/16 |

*Primary Examiner*—Joseph W. Hartary
*Attorney, Agent, or Firm*—Fitzpatrick, Cella, Harper & Scinto

[57] ABSTRACT

An ink jet recording head includes a top plate having recesses for forming ink paths connected to a plurality of ejection outlets from which ink is ejected; a substrate for forming the ink paths by joining it with the top plate, with the recesses facing inward; wherein the top plate overhangs from an edge of the substrate in the direction of a plane of the joint between the top plate and substrate.

10 Claims, 9 Drawing Sheets

INK JET RECORDING HEAD AND APPARATUS

FIELD OF THE INVENTION AND RELATED ART

The present invention relates to an ink jet recording head which records images by means of ejecting ink onto a piece of recording medium, and also to an ink jet recording apparatus comprising such an ink jet recording head. In this case, the terminology "record" means to "apply" the ink or the like to any ink receptive medium which includes fabric, yarn, paper, sheet material of various types, and the "recording apparatus" means an information processing apparatus itself inclusive of printer, or the printer itself as the output device, to which the present invention is applicable.

Among various types of presently known recording systems, the ink jet recording system has been recognized as an extremely effective recording system, since it is a non-impact recording system which generates little noise during recording; it is capable of recording at a high speed; and in addition, it is capable of recording on plain paper without requiring a special fixing process.

FIGS. 15 and 16 illustrate the essential portions of a typical ink jet recording head employed in such an ink jet recording system. FIG. 15 is a schematic perspective view thereof, and FIG. 16 is an exploded perspective view thereof. FIG. 17 is a schematic sectional view of the internal structure of the ink jet recording head, at sectional plane X—X.

Reference numeral 100 designates a base plate, on which various components (which will be described later) are constructed. On this base plate 100, a piece of substrate 200 (hereinafter, a heater board) is disposed, which comprises a plurality of electrothermal transducers (heaters) 201 as elements for ejection energy. On this heater board 200, an ink path (not illustrated) leading to a plurality of ink ejecting orifices 301 is located, and also, to a predetermined point thereof, a top plate 300 is joined. The top plate 300 comprises: an orifice plate 304 with the ink ejection orifices 301; a common liquid chamber 302 for storing the ink to be supplied through the aforementioned ink path; and a cylindrical ink inlet pipe for supplying the ink to this common liquid chamber 302. The top plate 300 is joined with the heater board 200 in the following manner. First, the top plate 300 is temporarily glued onto the heater board 200, in such a manner that the plurality of heaters 201 of the heater board 200 become aligned with the correspondent ink ejection orifices 301 of the top plate 300, and then, a mechanical pressure is applied, from above, to the top plate 300, with the use of a spring (unillustrated), so that two components can be satisfactorily joined in an airtight manner. Thereafter, the peripheries of the top plate 300 and heater board 200 are sealed with sealant 400 as shown in FIG. 17, whereby the ink path and common liquid chamber 302 are airtightly sealed.

It is well-known that liquid chamber partitioning walls 303 are disposed on the heater board 200 so as to form the common liquid chamber 302 on the inward facing surface of the heater board 200 (Japanese Laid-Open Patent Application No. 101,958/1991, or the like).

Recently, however, the size of the heater board has been progressively reduced in order to reduce the size of the ink jet recording head as well as the heater board cost. As the results of this size reduction, there have been cases in which it is difficult, in terms of space, to form the liquid chamber walls on the inward facing surface of the heater board in a conventional manner. In addition, the reduced size of the heater board results in a reduced distance between the heater board edge and the outermost ink ejection orifice, and as a result, the sealant for sealing the common liquid chamber is liable to flow sometimes into the ink ejection orifices, creating thereby such a problem that the ink cannot be ejected.

Accordingly, the primary object of the present invention is to provide a highly reliable ink jet recording head, which is even smaller in size and cost, and in which the sealant does not flow into the ink path, and also to provide an ink jet recording apparatus comprising such an ink jet recording head.

SUMMARY OF THE INVENTION

According to an aspect of the present invention, the top plate overhangs from the edges of the substrate in the direction of the joint between the top plate and substrate; therefore, the size of the substrate can be reduced compared to the conventional one. In addition, the joint becomes smaller than the conventional one; therefore, it is less probable that gaps will occur between the top plate and substrate due to the microscopic surface irregularities that are present in the joint. Consequently, the airtightness of the joint between the top plate and substrate is improved, preventing the sealant from flowing into the ink path. Further, since the top plate is disposed in such a manner as to overhang from the joint, the thickness of the top plate wall members that form the ink path is allowed to be substantially the same as those of the conventional design; therefore, their strength can be maintained at substantially the same level as the conventional one.

According to another aspect of the present invention, the overhanging portions of the top plate are extended in the thickness direction of the substrate, and the substrate is disposed between the two extended overhanging portions; therefore, the sealant can be more reliably prevented from flowing into the ink path. Further, the extended portions of the top plate embrace the substrate; therefore, the strength, or reliability, of the ink jet recording head itself is improved.

According to another aspect of the present invention, a portion of one of the common changer walls projects toward the element substrate, the wall being the one that opposes the orifice plate. This projecting portion causes the mechanical pressure, which is applied to the top plate as the top plate and element substrate are joined, to be concentrated toward the ink path wall side of the element substrate; therefore, the ink path walls of the top plate, and substrate, can be airtightly joined with more reliability. Consequently, the sealant for sealing the joint between the element substrate and top plate can be reliably prevented from flowing into the common liquid chamber and/or ink ejection orifices.

According to another aspect of the present invention, a part of the extended overhang portion of the liquid chamber wall is cut away; therefore, the adhesive used to join temporarily the top plate and element substrate can be reliably prevented from flowing into the ink path.

According to a further aspect of the present invention, notches are cut in the extended overhang portion of the liquid chamber wall; therefore, the surface area, which comes in contact with the adhesive used for joining temporarily the top plate and element substrate, can be increased, whereby the adhesive strength is improved.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
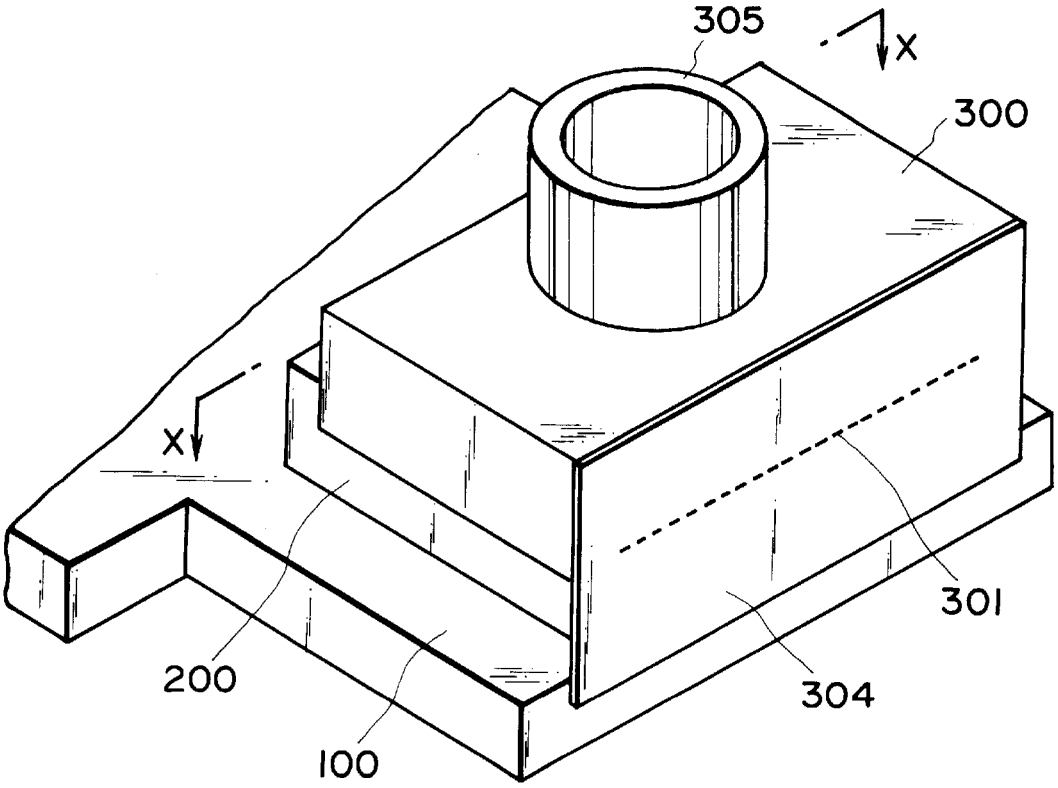
FIG. 1 is a schematic perspective view of the essential portions of the first embodiment of the ink jet recording head in accordance with the present invention.

Hereinafter, the embodiments of the present invention will be described in detail referring to the drawings.

Embodiment 1

Figure 2:
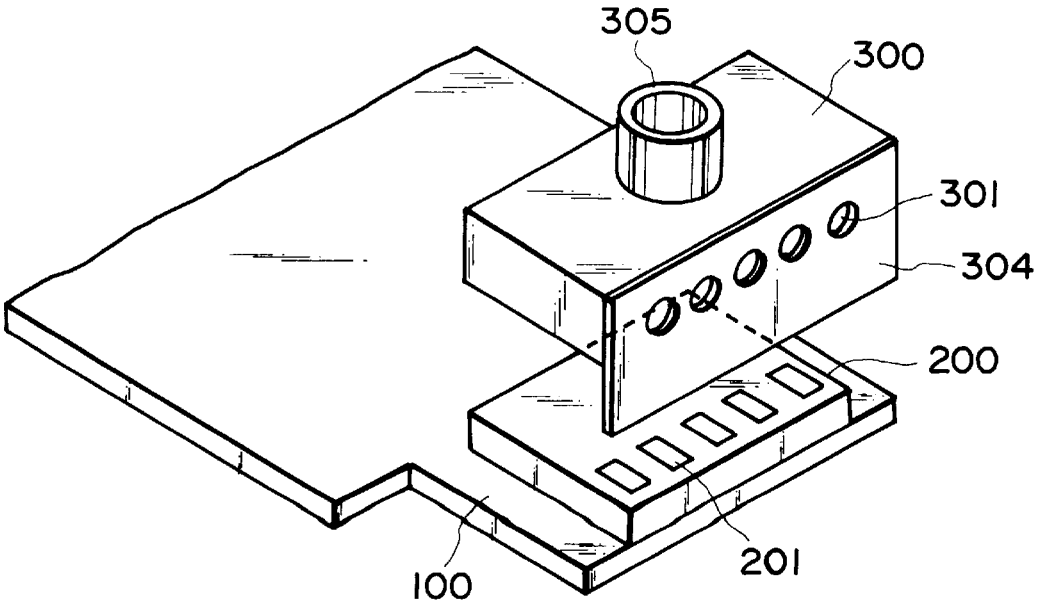
FIG. 2 is an exploded perspective view of FIG. 1.
Figure 3:
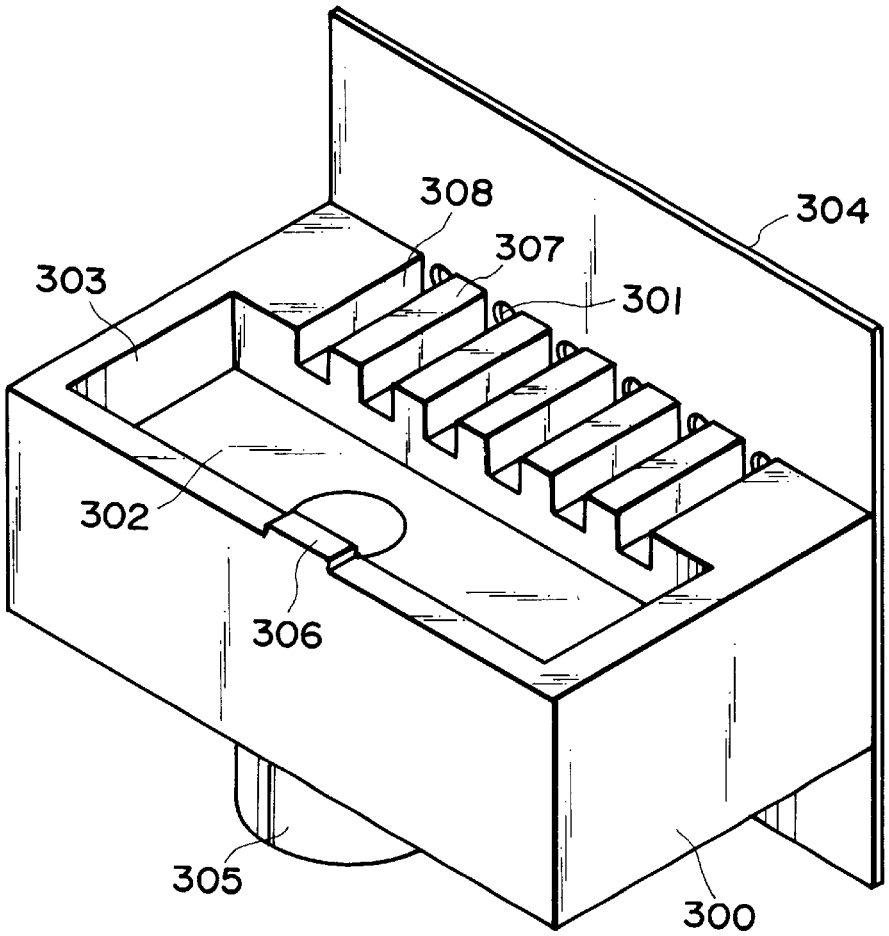
FIG. 3 is a schematic perspective view of the internal structure of the top plate of the first embodiment of the ink jet recording head in accordance with the present invention.
Figure 4:
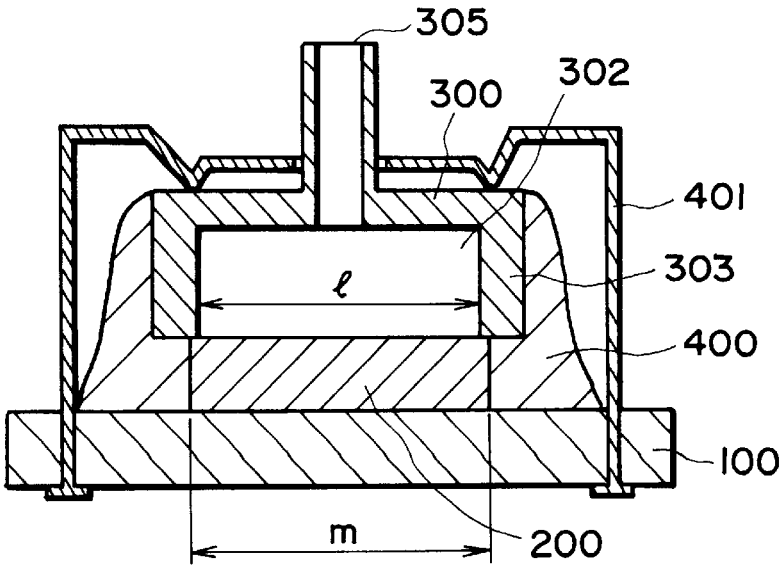
FIG. 4 is the sectional view of FIG. 1, at sectional plane X—X.
Figure 15:
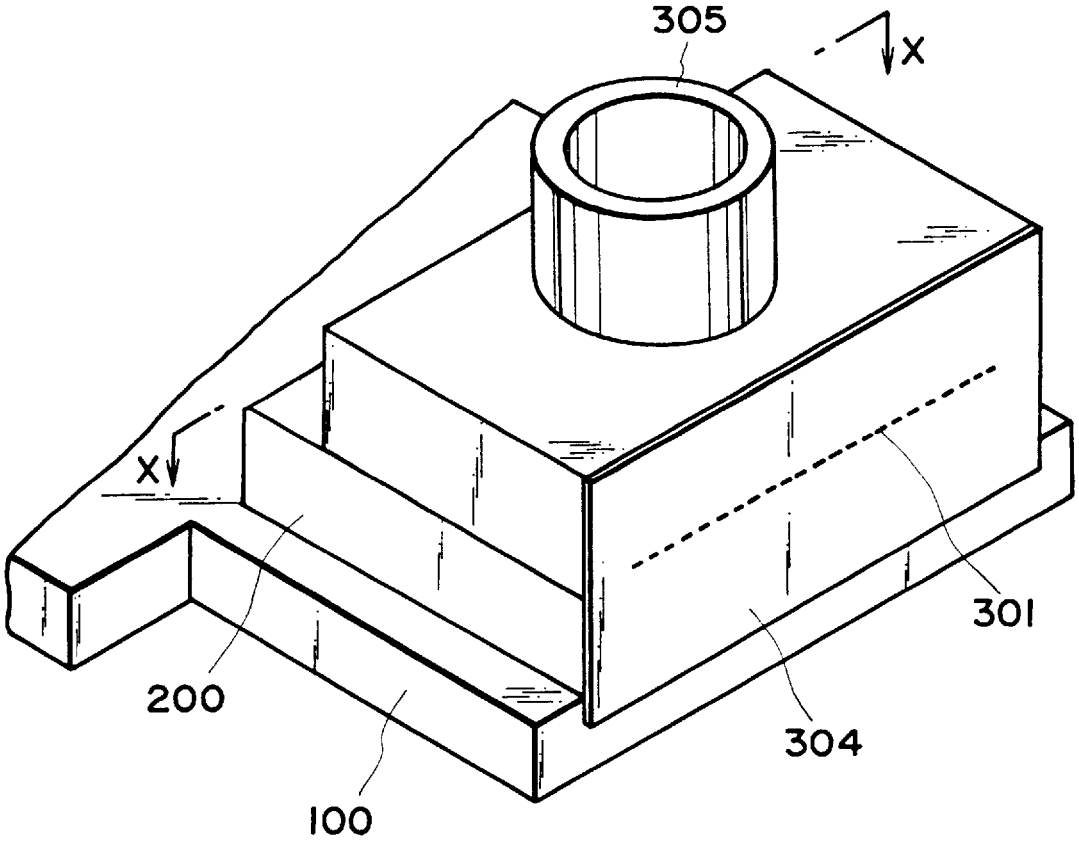
FIG. 15 PRIOR ART
FIG. 15 is a schematic perspective view of the essential portions of a typical, conventional ink jet recording head.
Figure 16:
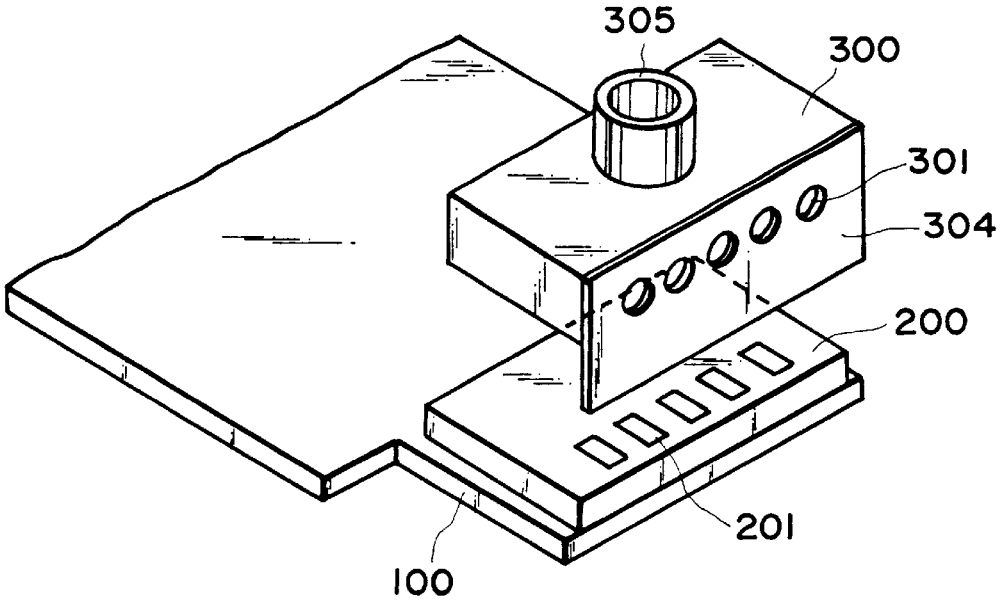
FIG. 16 PRIOR ART
FIG. 16 is an exploded perspective view of the essential portions of the typical, conventional ink jet recording head.
Figure 17:
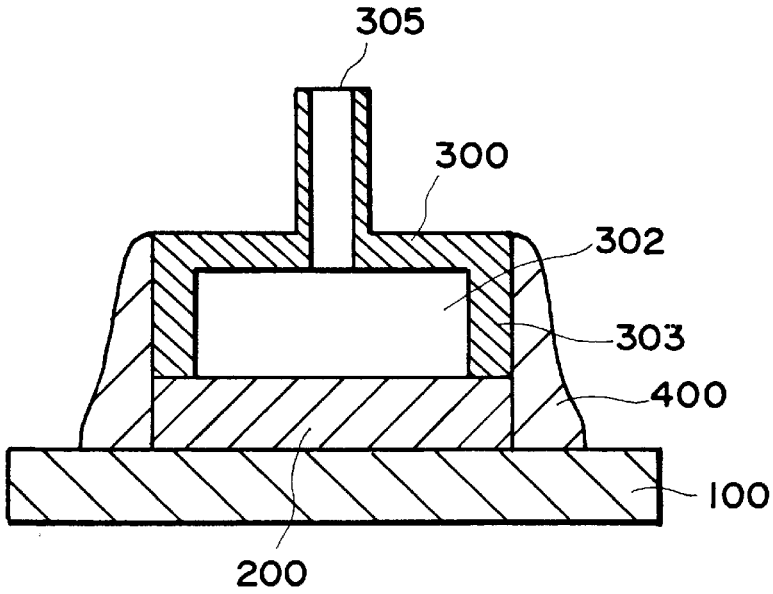
FIG. 17 PRIOR ART
FIG. 17 is a schematic sectional view of the internal structure of the ink jet recording head of FIG. 15, at sectional plane X—X.

FIGS. 1–4 depict the first embodiment of the ink jet recording apparatus in accordance with the present invention, wherein FIG. 1 is a schematic perspective view of the essential portions thereof; FIG. 2, an exploded perspective view of FIG. 1; FIG. 3, a schematic perspective view of the internal structure of the top plate; and FIG. 4 is a sectional view of FIG. 1, at sectional plane X—X. Among the structural components in this embodiment, those common to the conventional ink jet recording head illustrated in FIGS. 15–17 will be designated with the same references, and their descriptions will be omitted.

This embodiment is characterized in that the common liquid chamber wall 303 overhangs from the heater board 200, at both edges in the direction in which the plurality of heaters 201 are aligned on the heater board 200 as the element substrate, that is, in the direction in which the ejection orifices are aligned. This arrangement makes it possible to minimize the space occupied on the upward facing surface of the heater board 200 by the liquid chamber wall 303, that is, the portions involved to join the liquid chamber wall 303 and heater board 200; therefore, it is possible to reduce the heater board 200 size. Referring to FIG. 4, it is preferable that the relationship between width m, which is the width of the heater board 200 in the direction in which the plurality of heaters 201 are aligned, and width 1, which is the width of the common liquid chamber 302 in the same direction, satisfies the following formula: $m>1$. More specifically, the difference between m and 1 in this embodiment was set at 0.1 mm. Parenthetically, when the head was constructed with the relationship being: $m<1$, there was a problem in that the sealant flowed onto the upward facing surface of the heater board, and also into the ink ejection orifices 301.

Also, this embodiment is characterized in that projection 306 is provided on the top plate 300, behind the common liquid chamber 302, relative to the ejection orifice plate 304, as shown in FIG. 3. The common liquid chamber 302 is constituted of a recess formed in a surface of the top plate 300. In one of the lateral walls of the common liquid chamber 302, a plurality of ink passages 308 are formed in such a manner that each passage is correspondent to one of the plurality of ink ejection orifices 301 formed in the orifice plate 304, connecting thereby the common liquid chamber 302 and the ink ejection orifices 301. The aforementioned projection 306 is at the center portion of the opposite common chamber wall of this same common liquid chamber wall, in which the ink passages 308 are formed. The upward facing surfaces of the walls 303 of the common liquid chamber 302 constitute the surfaces to be joined with the heater board 200 of the top plate 300, but since the projection 306 is on one of these upward facing surfaces, the joint is actually constituted of the top surface of this projection 306, and the top surfaces of the plurality of the ink passage walls 307 that form the aforementioned plurality of ink passages 308. Therefore, the mechanical pressure applied to the top plate 300 by the leaf spring 401 is concentrated toward the ink passage walls 307. After the spring 401 is fitted, the peripheries of the top plate 300 and heater board 200 are sealed with the sealant 400 as shown in FIG. 4, and at this time, the sealant 400 invades into slight gaps formed by the projection 306, between the heater board 200 and common liquid chamber walls 303, and seals them airtightly. Since no gap is formed between the ink passage walls 307 and heater board 200, the sealant 400 externally seals the joint between the top plate 300 and heater board 200.

In this embodiment, the height of the projection 306 from the top surface of the common liquid chamber wall 303 is within a range of 5–20 $\mu$m. When it is no more than 5 $\mu$m, the satisfactory adhesion cannot be effected between the heater board 200 and ink passage walls 307, and when it is no less than 20 $\mu$m, the gap between the liquid chamber wall 303 and heater board 200 becomes excessively large, creating thereby a problem occasionally in that the sealant 400 flows onto the top surface of the heater board 200, and also into the ink ejection orifices.

Embodiment 2

FIGS. 5–8 illustrate the second embodiment of the ink jet recording head in accordance with the present invention.

Figure 5:
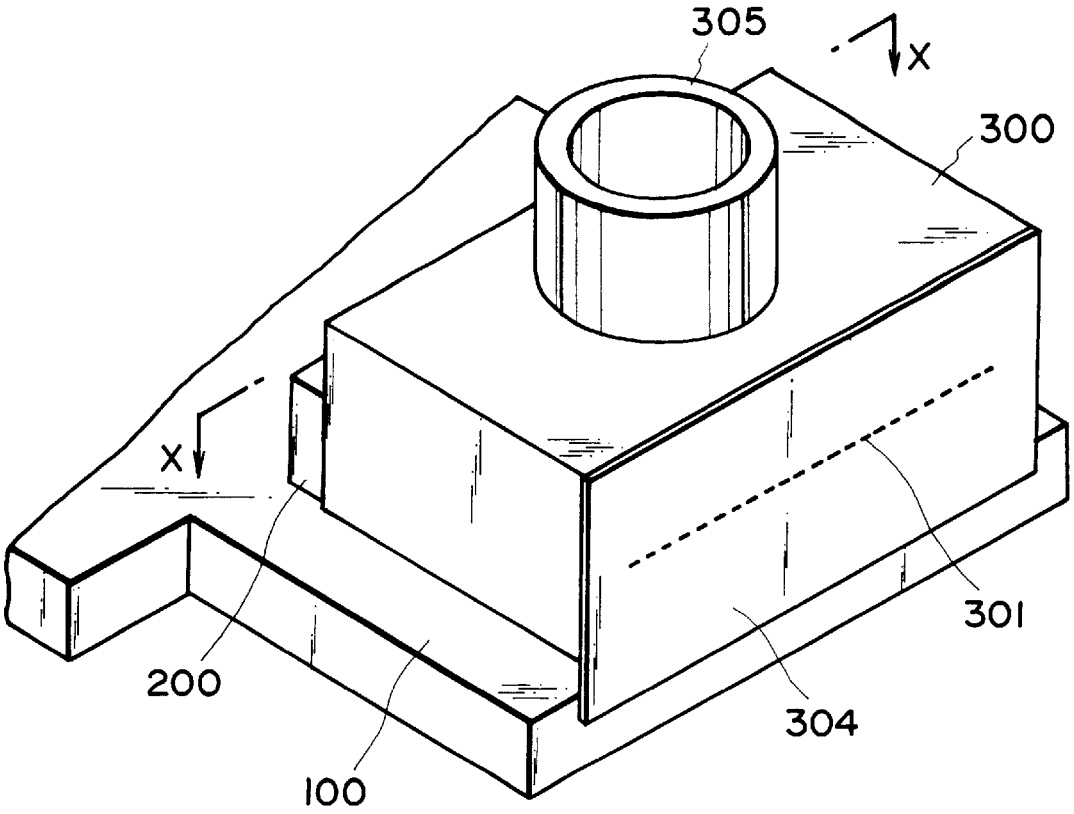
FIG. 5 is a schematic perspective view of the essential portions of the second embodiment of the ink jet recording apparatus in accordance with the present invention.
Figure 6:
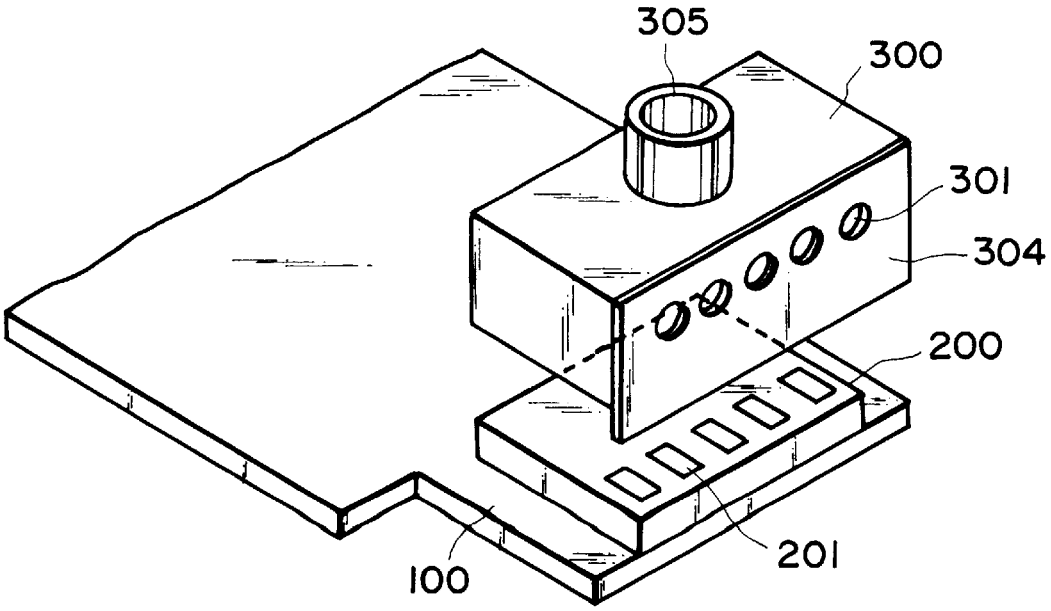
FIG. 6 is an exploded perspective view of FIG. 5.
Figure 7:
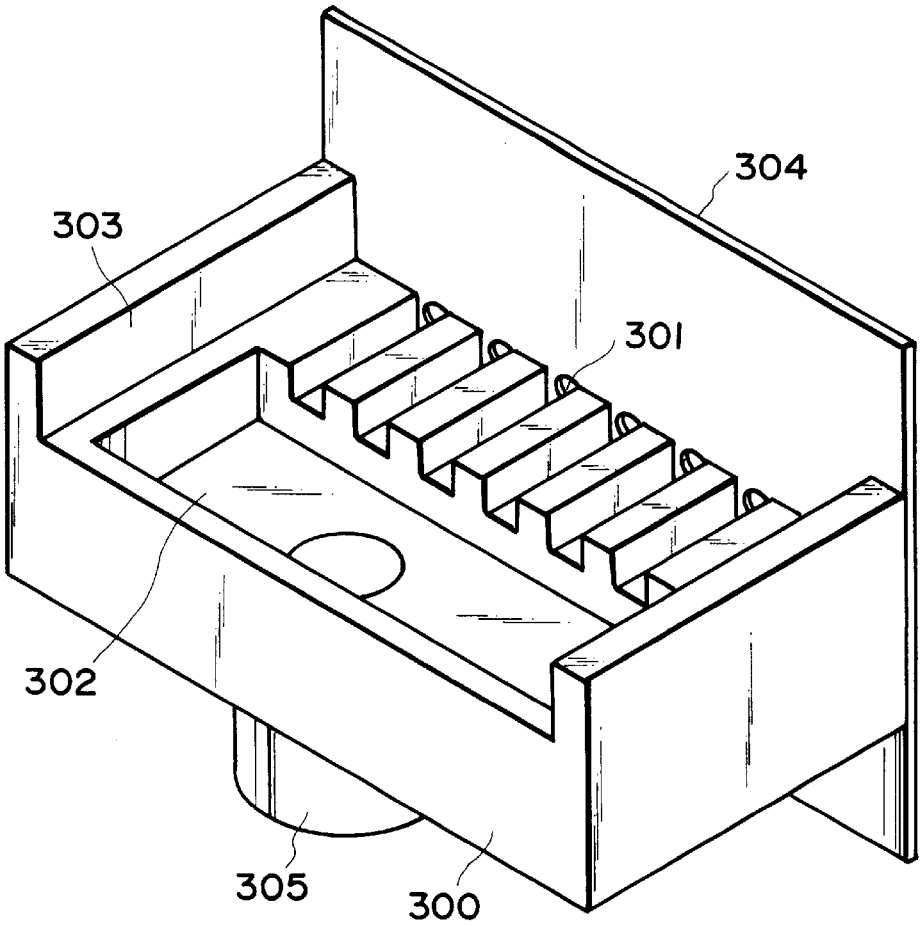
FIG. 7 is a schematic perspective view of the internal structure of the top plate in the second embodiment of the ink jet recording apparatus in accordance with the present invention.
Figure 8:
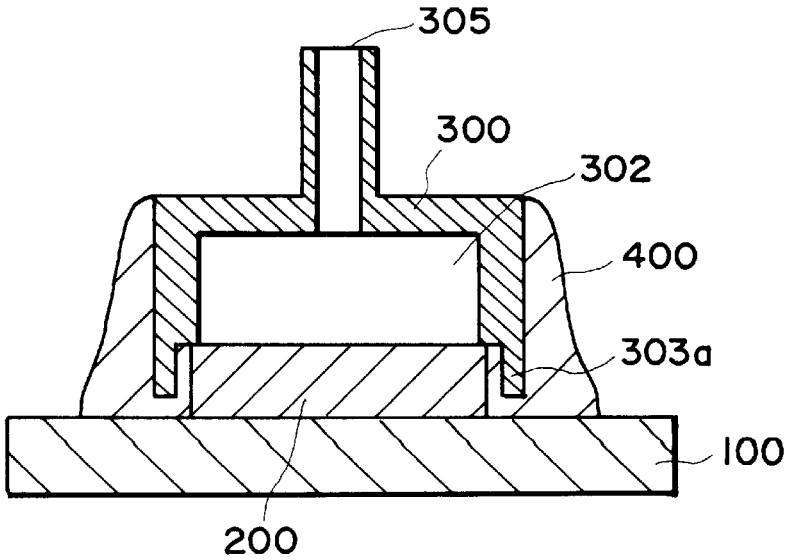
FIG. 8 is a sectional view of FIG. 5, at sectional plane X—X.

FIG. 5 is a schematic perspective view of the essential portions thereof; FIG. 6, a schematic perspective view of the internal structure of the top plate; and FIG. 7 is a sectional view of FIG. 5, at sectional plane X—X. Also in this embodiment, the structural components common to the conventional ink jet recording head illustrated in FIGS. 15–17, and also to preceding embodiment, are designated with the same references, and their descriptions will be omitted.

This embodiment is characterized in that the heater board 200 is disposed between the opposing two walls 303*a* of the common liquid chamber 303 of the top plate 300, which extend in the direction perpendicular to the alignment direction of the plurality of ink ejection orifices 301 of the orifice plate 304. The liquid chamber walls 303*a* extend far beyond the top surfaces of the liquid chamber walls 303 as shown in FIG. 7, and function, like a dam, to prevent the invasion of the sealant 400 used to seal externally the common liquid chamber 302 of the top plate 300. As for the amount of the projection of the liquid chamber wall 303*a* in this embodiment, it is set to be less than the thickness of the heater board 200. This is because, if the amount of the projection is set to be more than the thickness of the heater board 200, the sealant 400 cannot be successfully prevented from flowing into the common liquid chamber 302, and also, in some cases, the interface between the ink passage walls 307 and heater board 200 cannot be satisfactorily sealed.

Thus, this embodiment enjoys the following effects in addition to those of the preceding embodiment. That is, the sealant 400 is reliably prevented from flowing into the common liquid chamber 302, so that the ink ejection orifices 301 do not become plugged up with the sealant 400; therefore, the ink can be reliably ejected to record high quality images.

Embodiment 3

Figure 9:
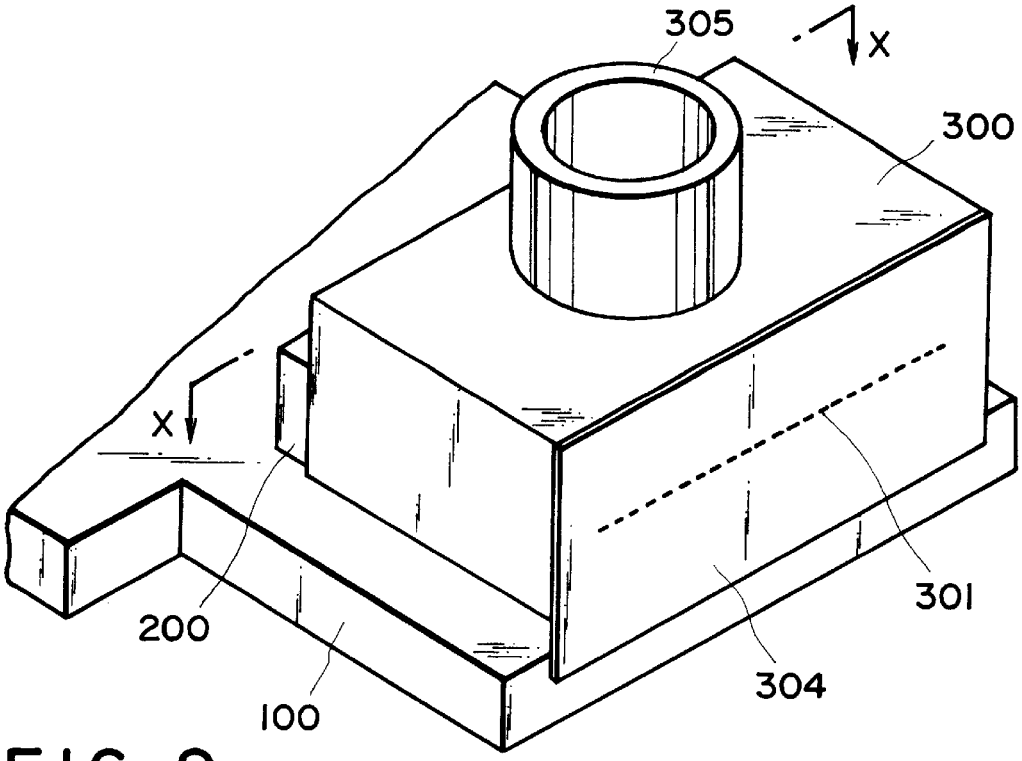
FIG. 9 is a schematic perspective view of the essential portions of the third embodiment of the ink jet recording apparatus in accordance with the present invention.
Figure 10:
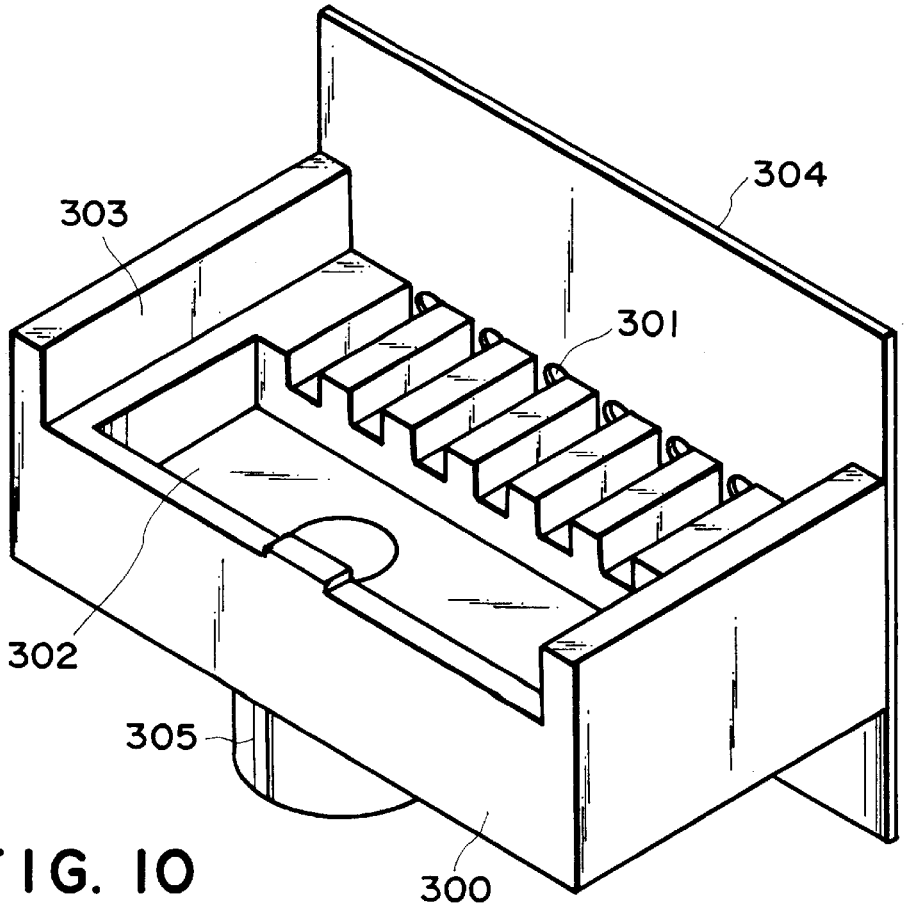
FIG. 10 is a schematic perspective view of the internal structure of the top plate in the third embodiment of the ink jet recording head in accordance with the present invention.
Figure 11:
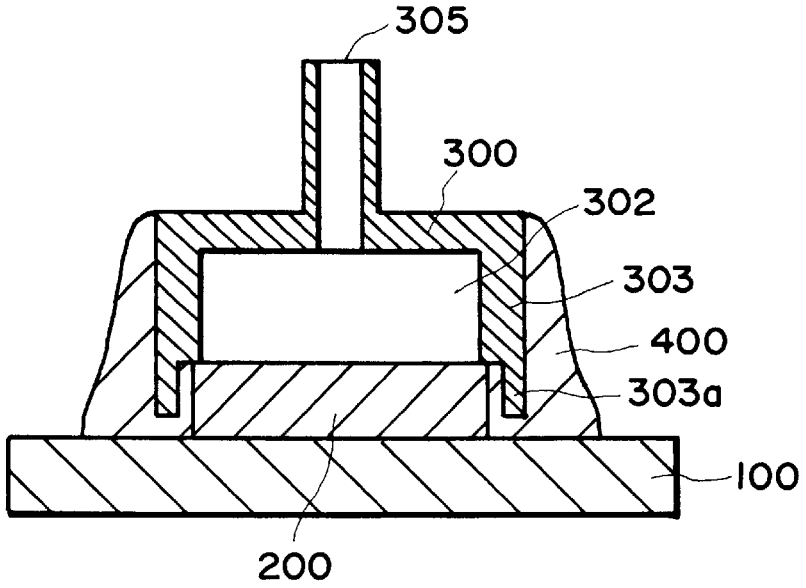
FIG. 11 is a sectional view of FIG. 9, at sectional plane X—X.

FIGS. 9–11 depict the third embodiment of the ink jet recording apparatus in accordance with the present invention, wherein FIG. 9 is a schematic perspective view of the essential portions thereof; FIG. 10, a schematic perspective view of the internal structure of the top plate; and FIG. 11 is a sectional view of FIG. 9, at sectional plane X—X. Also in this embodiment, the structural components common to the conventional ink jet recording head illustrated in FIGS. 15–17, and also to the preceding embodiments, are designated with the same references, and their description will be omitted.

This embodiment is characterized in that not only the projection 306 described in the preceding first embodiment is provided, but also, the heater board 200 is disposed between the opposing two walls 303*a* of the common liquid chamber 303 of the top plate 300, which extend in the direction perpendicular to the alignment direction of the plurality of ink ejection orifices 301 of the orifice plate 304. The liquid chamber walls 303*a* extends far beyond the top surfaces of the other liquid chamber walls 303 as shown in FIG. 11, and function, like a dam, to prevent the invasion of the sealant 400 used to seal externally the common liquid chamber 302 of the top plate 300. As for the amount of the projection of the liquid chamber wall 303*a* in this embodiment, it is set to be less than the thickness of the heater board 200. This is because, if the amount of the projection is set to be more than the thickness of the heater board 200, the sealant 400 cannot be successfully prevented from flowing into the common liquid chamber 302, and also, in some cases, the interface between the ink passage walls 307 and heater board 200 cannot be satisfactorily sealed.

Thus, this embodiment enjoys the following effects in addition to those of the preceding embodiments. That is, the sealant 400 is reliably prevented from flowing into the common liquid chamber 302, so that the ink ejection orifices 301 do not become plugged up with the sealant 400; therefore, the ink can be reliably ejected to record high quality images.

Embodiment 4

Figure 12:
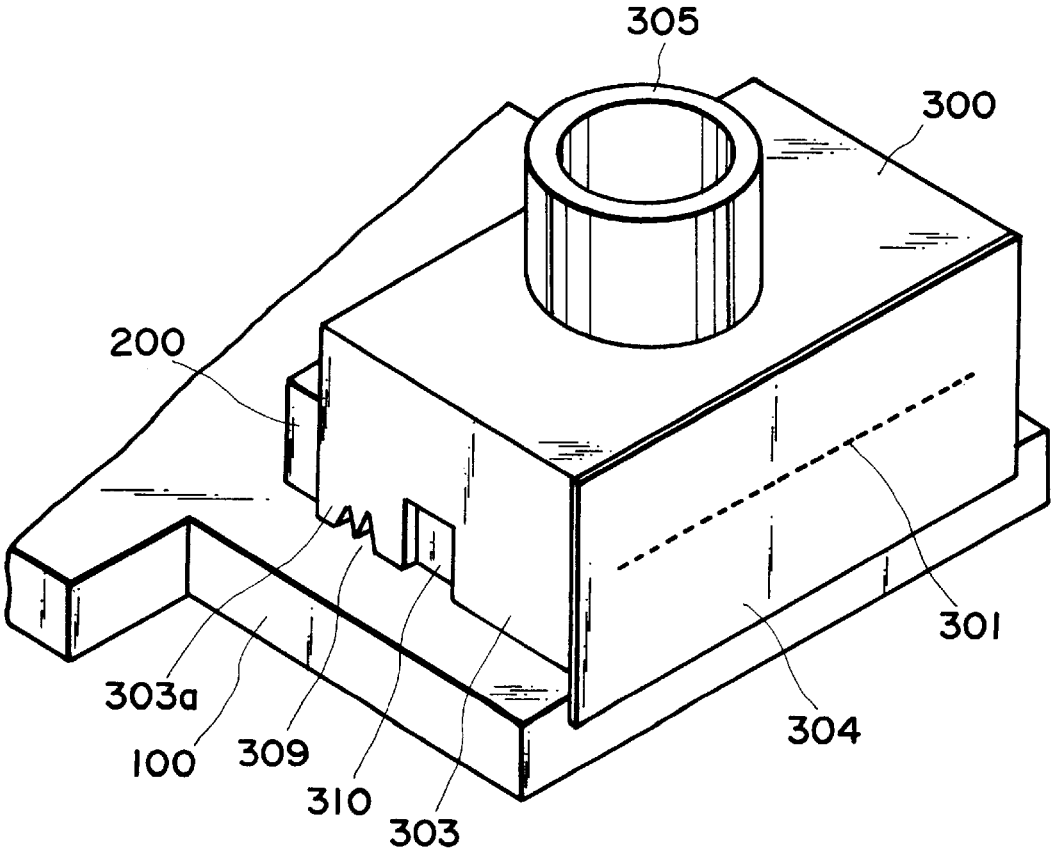
FIG. 12 is a schematic perspective view of the essential portions of the fourth embodiment of the ink jet recording head in accordance with the present invention.
Figure 13:
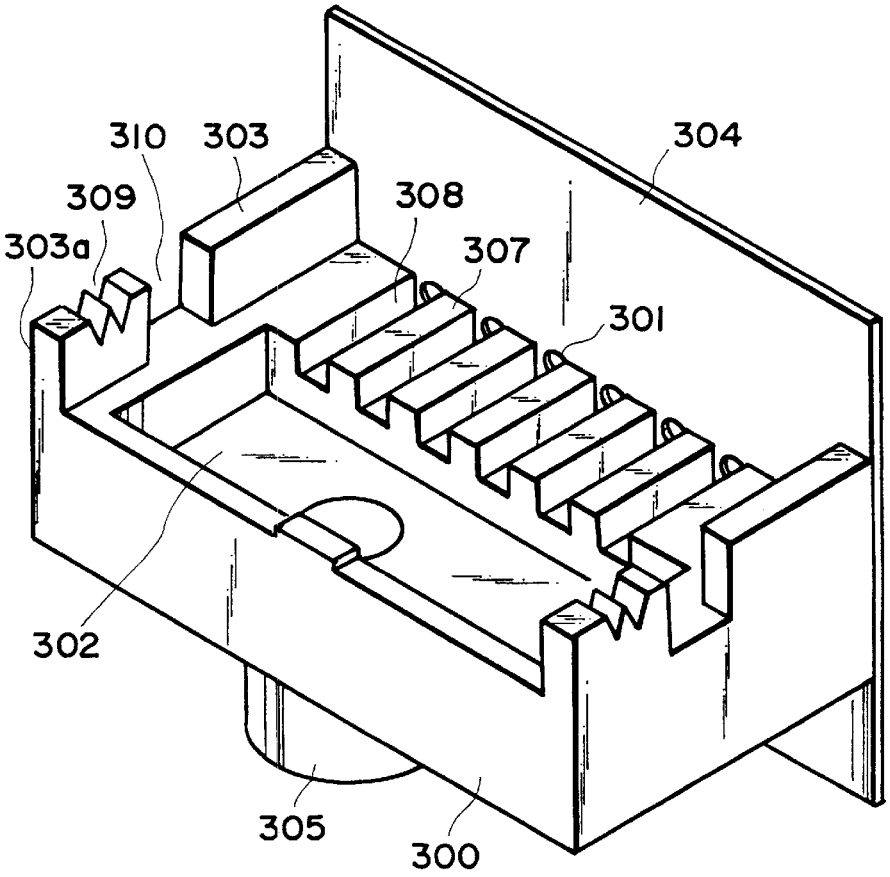
FIG. 13 is a schematic perspective view of the internal structure of the top plate in the fourth embodiment of the ink jet recording head in accordance with the present invention.

FIGS. 12 and 13 illustrate the fourth embodiment of the ink jet recording head in accordance with the present invention. FIG. 12 is a schematic perspective view of the essential portions thereof, and FIG. 13 is a schematic perspective view of the internal structure of the top plate. Also in this embodiment, the structural components common to the conventional ink jet recording head illustrated in FIGS. 15–17, and also to the preceding embodiments, are designated with the same alphanumeric references.

Embodiment 4

FIGS. 12 and 13 depict the fourth embodiment of the ink jet recording apparatus in accordance with the present invention, wherein FIG. 12 is a schematic perspective view of the essential portions thereof, and FIG. 13 is a schematic perspective view of the internal structure of the top plate. Also in this embodiment, the structural components common to the conventional ink jet recording head illustrated in FIGS. 15–17, and also to the preceding embodiments, are designated with the same alphanumeric references, and their descriptions will be omitted.

This embodiment is characterized in that a pair of notches 309, and opening 310 (cutaway portion), are cut into both of the liquid chamber walls 303*a* described in the preceding embodiment 3. The notched portion 309 is positioned away from the orifice plate 304, that is, closer to the liquid chamber wall 303 opposing the ink ejection orifices 301. This notched portion 309 functions to fix temporarily the positional relationship between the heater board 200 and top plate 300, when the two components are joined with adhesive (normally, UV-curing adhesive). The provision of this type of notched portion 309 increases the area of adhesion; therefore, adhesive strength is increased. As for the cutaway portion 310, it is formed by means of cutting away a portion of the liquid chamber wall 303*a* from the top surface of the liquid chamber wall 303*a* to the top surface of the liquid chamber wall 303. The purpose of this type of cutaway portion 310 is to prevent effectively the adhesive applied to the notched portion 309 for the temporary fixation, from flowing toward the ink ejection orifices 301, and plugging them, while the adhesive hardens. Therefore, it is important that this cutaway portion 310 is positioned at the end portion of ink path 308, that is, at the end portion away from the ink ejection orifices 301.

Thus, this embodiment enjoys the following effects in addition to those of the preceding embodiments. That is, not only can the temporary fixation between the heater board 200 and top plate 300 reliably occur with the presence of the notched portion 309 that is cut, as a barrier for preventing the sealant 400 from flowing into the common liquid chamber 302, in the liquid chamber wall 303*a*, but also, the adhesive used for the temporary fixation can be prevented from flowing into the area of ink ejection orifices 301, by the cutaway portion 310; therefore, the ink ejection orifice 301 is prevented from being plugged up with the adhesive, allowing thereby the ink to be reliably ejected to record high quality images.

Figure 14:
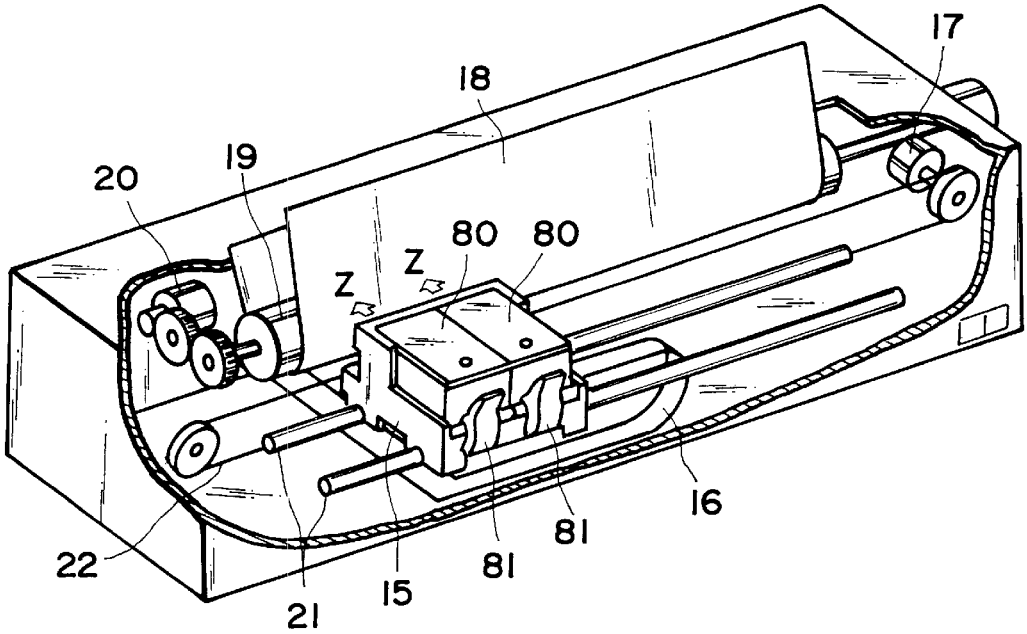
FIG. 14 PRIOR ART
FIG. 14 is a schematic perspective view of an embodiment of the ink jet recording apparatus in accordance with the present invention.

Those ink jet recording heads described in the preceding embodiments of the present invention are mountable in such an ink jet recording apparatus as the one illustrated in FIG. 14. FIG. 14 is a schematic perspective view of an embodiment of the ink jet recording apparatus in accordance with the present invention.

Referring to FIG. 14, reference numeral 80 designates a cartridge, which is fixed on carriage 15 with the use of retaining member 81. These are reciprocative in the longitudinal direction of shaft 21 (primary scanning direction). The position of the cartridge 80 on the carriage 15 is fixed by a hole provided in the lid, and a dowel or the like provided on the carriage 15. As for the electrical connection, it is established when a contact pad provided on a wiring substrate is placed in contact with a connector provided on the carriage 15.

Recording medium 18 is put through a minute gap between the recording head and platen 19, and its recording surface is regulated by the platen 19. The ink ejected from a recording head reaches the surface of the recording medium 18, where it forms an image.

To the recording head, ejection signals reflecting image data are sent from an appropriate data source through cable 16 and a terminal connected thereto. The number of cartridge 80 may be one, or two or more, depending on the number of inks, or the colors of the image (two in this drawing).

Also referring to FIG. 14, reference numeral 17 designates a carriage motor, which moves the carriage 15 along the shaft 21; 22, a wire for transmitting the driving force of the motor 17 to the carriage 15; and 20 designates a feeder motor, which is connected to the platen 19 to feed the recording medium 18.

As for the form of the ink jet recording apparatus to which the present invention is applicable, it may be in the form of an image outputting peripheral device of an information processing apparatus such as a computer. Also, it may be in the form of a copying machine that integrally comprises a reader or the like, and also in the form of a facsimile with both the transmitting and receiving capacities.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet recording head comprising:

a plurality of ejection outlets;

a top plate having a plurality of recesses and a plurality of walls defining a common ink chamber therein for containing ink; and a substrate having an edge, said substrate being joined to said top plate along a joint defining a plane having a direction, said substrate and said top plate together forming ink paths connected to said plurality of ejection outlets through which ink is ejected from said common ink chamber, with said recesses facing said common ink chamber with said plurality of ejection outlets at a first one of said walls, said substrate having a thickness direction, wherein said top plate overhangs from said edge of said substrate in said direction of said plane, said top plate having two overhanging portions extending in the thickness direction of said substrate, said overhanging portions having a cutaway portion, said substrate being disposed between said overhanging portions.

2. An ink jet recording apparatus according to claim 1, wherein each ink path comprises an ink passage connected between a respective one of said ink ejection outlets and said common ink chamber.

3. An ink jet recording head according to claim 2, further comprising energy generating means for generating energy to be used for ejecting the ink through said plurality of ejection outlets, said energy generating means being disposed along said ink passages.

4. An ink jet recording head according to claim 3, wherein said energy generating means comprises a thermal energy generating member for generating thermal energy to cause the ink to film-boil.

5. An ink jet recording head according to claim 4, wherein said thermal energy generating member includes an electrothermal transducer.

6. An ink jet recording head according to claim 2, wherein a projection is provided on such a portion of the walls forming the common ink chamber of said top plate as is away from the plurality of ejection outlets.

7. An ink jet recording head according to claim 1, wherein said top plate comprises an orifice plate in which said plurality of ejection outlets are aligned.

8. An ink jet recording head according to claim 1, wherein said top plate and substrate are joined under mechanical pressure.

9. An ink jet recording head according to claim 1, further comprising a base plate for mounting said substrate.

10. An ink jet recording apparatus comprising:

an ink jet recording head comprising;

a plurality of ejection outlets;

a top plate having a Plurality of recesses and a plurality of walls defining a common ink chamber therein for containing ink;

a substrate having an edge, said substrate being joined to said top plate along a joint defining a plane having a direction, said substrate and said top plate together forming ink paths connected to said plurality of ejection outlets through which ink is ejected from said common ink chamber, with said recesses facing said common ink chamber with said plurality of ejection outlets at a first one of said walls, said substrate having a thickness direction, wherein said top plate is disposed to overhang from said edge of said substrate in said direction of said plane, said top plate having two overhanging portions extending in the thickness direction of said substrate, said overhanging portions having a cutaway portion, said substrate being disposed between said overhanging portions; and a mounting member for mounting said ink jet recording head.

* * * * *